United States Patent [19]

Jaarsma

[11] 4,277,000

[45] Jul. 7, 1981

[54] MULTI-COMPARTMENT CONTAINERS

[75] Inventor: Frank C. Jaarsma, Chatham, N.J.

[73] Assignee: Celanese Corporation, New York, N.Y.

[21] Appl. No.: 39,721

[22] Filed: May 17, 1979

[51] Int. Cl.[3] ..... B65D 1/04; B43L 25/04

[52] U.S. Cl. ..... 222/142.4; 215/6; 220/22

[58] Field of Search ..... 222/142.1, 142.4, 142.5, 222/129, 542, 144.5; 220/20, 22; 215/6

[56] References Cited

U.S. PATENT DOCUMENTS

| | | | |
|---|---|---|---|
| 132,020 | 10/1872 | Odell | 215/6 |
| 223,162 | 12/1879 | Nuubson | 220/20 |
| 1,964,362 | 6/1934 | Nassif | 222/144.5 X |

FOREIGN PATENT DOCUMENTS

| | | | |
|---|---|---|---|
| 293571 | 7/1928 | United Kingdom | 222/142.5 |
| 1138690 | 1/1969 | United Kingdom | 222/144.5 |

*Primary Examiner*—Robert J. Spar

*Assistant Examiner*—Frederick R. Handren

*Attorney, Agent, or Firm*—John A. Shedden

[57] ABSTRACT

A multi-compartment container includes a molded body and a molded cap secured thereto. The body includes a confining wall forming a space, an internal dividing wall forming separate compartments within the space, and a base. The interface between the dividing wall and an inner side surface of the body defines a fluid seal between the compartments. The dividing wall forms an opening at an upper end of the body which communicates with one of the compartments. The cap is secured to the upper end of the body to form a seal therearound. The cap includes a first port aligned with the opening in the dividing wall to form a passage therewith, and a second port communicating with the other compartment. A compressible endless seal ring is mounted in a groove in either the cap or the dividing wall to form a seal around the passage at the interface between the first port and the opening when the cap is installed onto the body portion.

11 Claims, 9 Drawing Figures

MULTI-COMPARTMENT CONTAINERS

BACKGROUND AND OBJECTS OF THE INVENTION

The present invention relates to multi-compartment containers and, more particularly, to a container formed of molded components and having two completely separate internal compartments with individual outlet ports.

Containers having multiple internal compartments for containing different substances have been heretofore proposed, as evidenced for example, by the following U.S. Pat. Nos. 3,081,926 issued to Newton on Mar. 19, 1963; 3,347,420 issued to Donoghue on Oct. 17, 1967; 3,358,882 issued to Mathison on Dec. 19, 1967; and 3,680,740 issued to Kinnavy on Aug. 1, 1972.

In previously proposed multi-compartment containers there may be provided a body portion having an internal dividing wall which forms separate compartments within the body portion. A cover member is secured atop the body portion and includes separate ports which communicate with the respective compartments. A problem which can occur in connection with such an arrangement involves the creation of a seal between the compartments, and especially along the top edge of the divider wall, since such edge is not accessible after the top has been applied. A similar problem may exist in relation to the bottom edge of the divider wall if a separate bottom closure is to be secured at the lower end of the container.

It would be desirable to create an effective seal between the compartments upon installation of the cover and/or bottom closure and to enable the container to be fabricated economically, such as by injection molding.

It is, therefore, an object of the invention to provide an effective and economical solution to problems of the type noted above.

It is another object of the invention to provide a novel multi-compartment container having effective sealing between compartments.

It is a further object of the invention to enable a multi-compartment container to be formed by a molding process whereby sealing between compartments is effected upon assemblage of the container components.

It is an additional object of the invention to provide a simple and inexpensive manner of sealing between compartments in a multi-compartment container.

It is still another object of the invention to provide a multi-compartment container having a divider wall which is integral at one end with an inner side surface of the container and forms an opening at another end, whereby an endless seal may be positioned around the opening.

SUMMARY OF THE INVENTION

These objects are achieved by the present invention in which a multi-compartment container includes a body and a cap. The body comprises an upper body portion and a base. The upper body portion includes a confining wall forming upper and lower ends and an inner space therewithin, and a divider wall dividing the inner space into a plurality of compartments. The divider wall intersects an internal surface of the confining wall and forms an opening at an upper end of the body communicating with a first of the compartments. The cap is secured to the upper end of the body to form a seal therearound. The cap includes a first port communicating with the opening to form a passage therewith, and a second port communicating with a second one of the compartments. An endless seal surrounds the passage at the interface between the second port and the opening to provide a seal between the compartments.

DESCRIPTION OF THE DRAWING

The advantages of the present invention will become apparent from the following detailed description of a preferred embodiment thereof in connection with the accompanying drawing in which like numerals designate like elements and in which.

DETAILED DESCRIPTION OF PREFERRED EMBODIMENTS OF THE INVENTION

Figure 1:
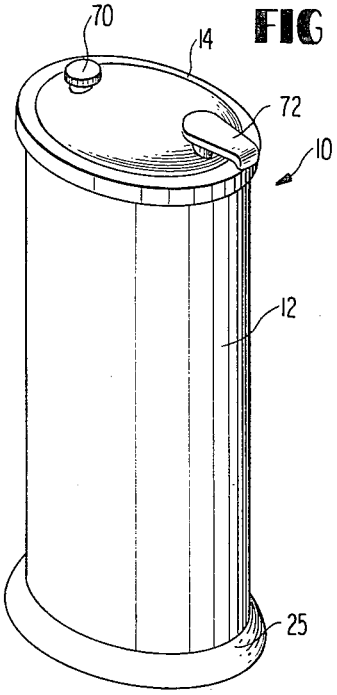
FIG. 1 is a perspective view of a container according to the present invention.

A preferred form of multi-compartmented container 10 according to the present invention is depicted in FIGS. 1 to 6. The container 10 comprises three basic components which are separately formed and thereafter secured together, viz., an upper body portion 12, a top cap portion 14, and a bottom closure or base 16. The upper body 12 and the bottom closure 16 together form a body which carries the cap 14.

The upper body portion 12 comprises a confining wall 18 and a divider wall 20. The upper body portion 12 is preferably formed of thermoplastic material by an injection molding process such that the walls 18, 20 are of integral one-piece construction. The wall 18 is of oval or elliptical cross-sectional configuration (FIG. 3) and has top and bottom ends 22, 24. If desired, the wall 18 can take other cross-sectional shapes, such as circular; octagonal; etc., including one where cross-sectional shape continuously varies from cap to base.

Figure 2:
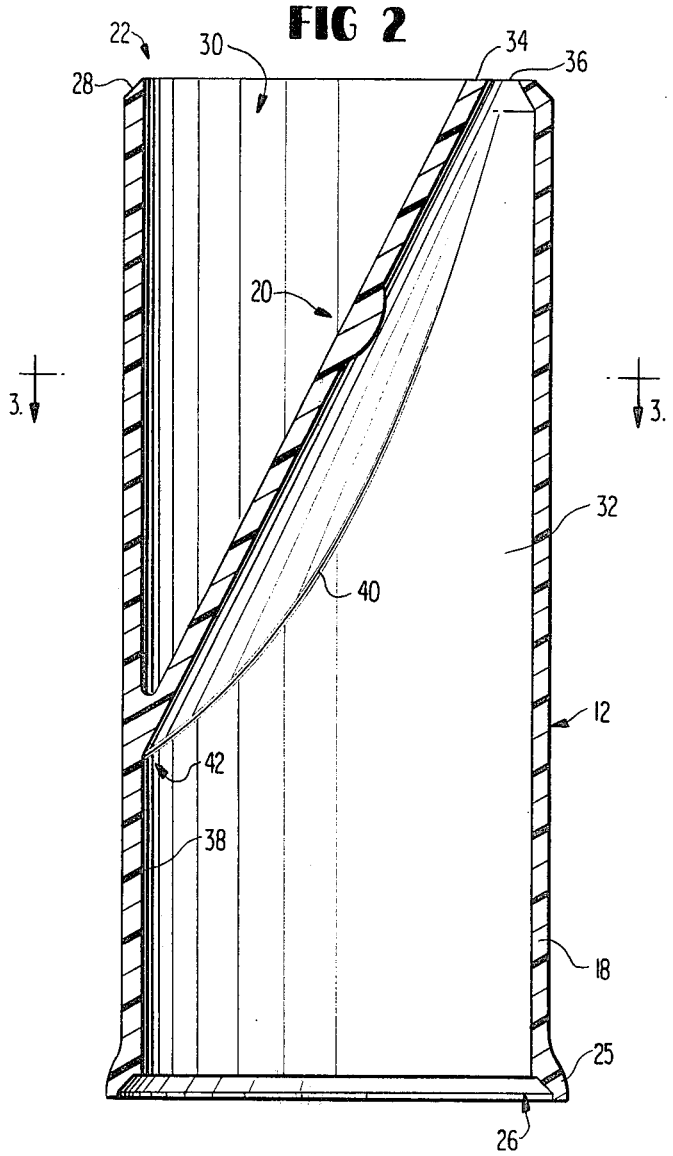
FIG. 2 is a longitudinal sectional view taken through a body portion of the container.

Preferably, the bottom end of the upper body portion 12 includes an enlargement 25 having an annular downwardly open recess 26 (FIG. 2).

Preferably the top end 22 of the upper body portion includes a bevelled edge 28.

The divider wall 20 serves to partition the inner space defined by the confining wall 18 into separate compartments 30, 32 and is characterized by the fact that the only exposed edge of the divider wall comprises an endless shoulder or edge 34 which defines an opening 36 in communication with one of the compartments 32. By "exposed edge" is meant an edge which must later be sealed to prevent leakage between compartments. Preferably, the opening 36 is spaced laterally of a longitudinal axis of the confining wall 18.

Along the remainder of its periphery, the divider wall is joined to an inner side surface 38 of the wall 18, so as to inherently prevent leakage therealong.

Figure 3:
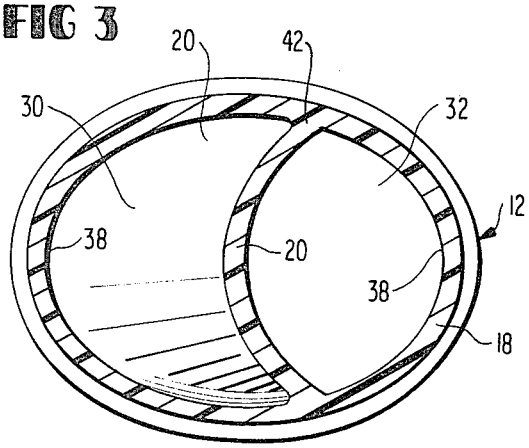
FIG. 3 is a cross-sectional view of the body portion taken along line 3—3 of FIG. 2.
Figure 4:
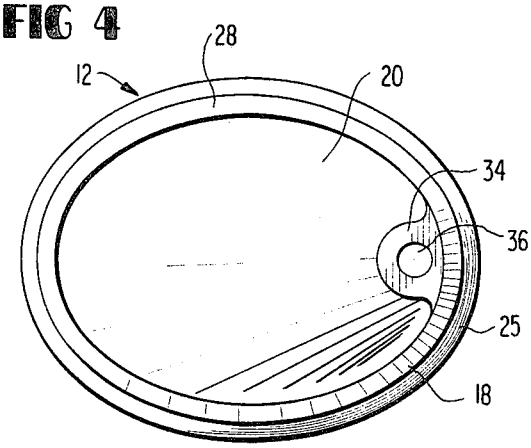
FIG. 4 is a plan view of the body portion.
Figure 5:
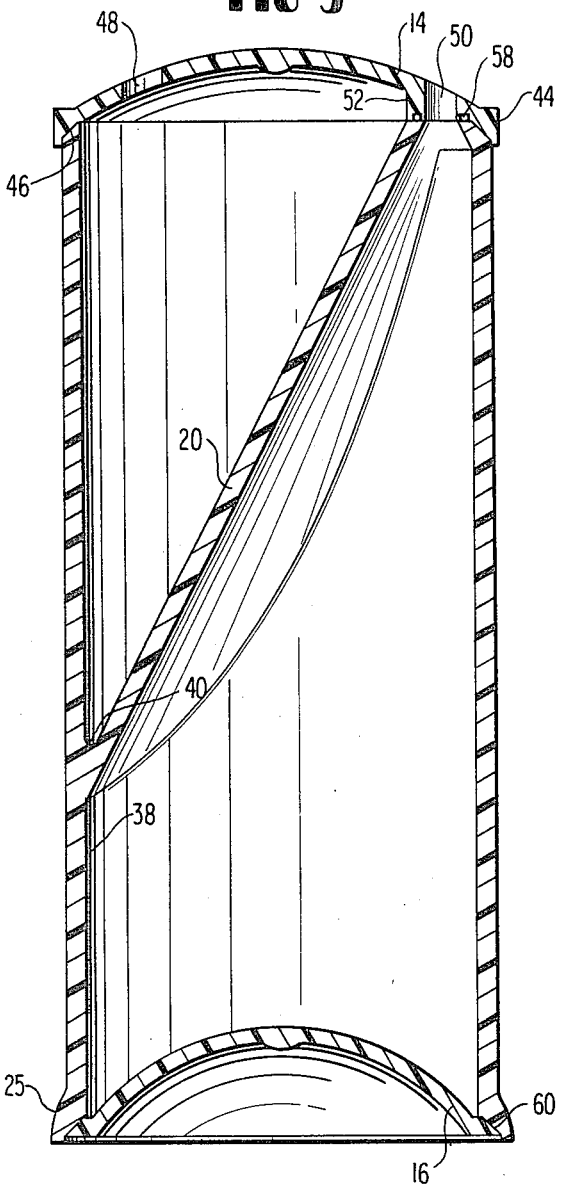
FIG. 5 is a longitudinal sectional view through the container with the body portion, cap portion, and bottom closure portion assembled together.
Figure 6:
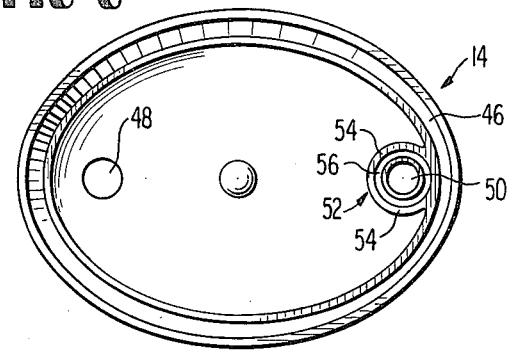
FIG. 6 is a bottom view of the cap portion.

It is to be understood that the divider wall may assume numerous configurations to achieve the desired result. In one preferred configuration (FIGS. 1–6), the divider wall is curved and tapers from bottom to top (FIGS. 3–4). Thus, along what may be termed a side edge 40 of the divider wall, the divider wall is joined to the wall 18 in a leak-proof manner. The lowermost end 42 of the divider wall is located intermediate the top and bottom ends 22, 24 of the upper body 12. The volumes of the compartments 30, 32 will vary, depending upon such location. If desired, the divider wall can extend essentially to the bottom of the upper body 12.

At its upper end, the divider wall 20 closes off the compartment 32 except for the opening 36 defined by the edge 34. The opening 36 can assume various shapes such as the circular shape illustrated in FIGS. 1 to 6.

As noted earlier, the confining wall 18 and the divider wall 20 are preferably formed as one integral piece of thermoplastic material by conventional injection molding techniques. Since the side edge or periphery 40 of the divider wall 20 is integral with the inner surface 38 of the confining wall 18, leakage along such periphery between the compartments is inherently prevented.

The top cap 14 comprises a generally inverted cup-shaped element, preferably formed of thermoplatic material by an injection molding process. The cap includes an annular flange 44 defining the outer periphery thereof. The flange includes an edge in the form of a downwardly open annular recess 46 configured to mate with the upper edge 28 of the upper body portion 12.

A pair of ports 48, 50 are provided in the cap. One of the ports 48 is circular and is adapted to communicate with one 30 of the compartments, while the other port 50 comprises a cylindrical collar 52 which projects downwardly and has a bottom edge or shoulder 54 overlying and adapted to engage (or substantially engage) the edge or shoulder 34 which surrounds the opening 36 in the divider wall 20. The shoulder 54 of the cap 14 is shaped correspondingly to the shoulder 34 of the divider wall, viz., circular in the preferred embodiment of FIGS. 1 to 6.

When the cap 14 is installed onto the body portion, the port 50 communicates with the opening 36 to form a passage therewith.

The shoulder 54 on the cap 14 includes a downwardly open endless groove 56 adapted to receive a compressible endless seal ring 58. Preferably, the groove 56 and seal ring 58 are circular. It will be appreciated that when the cap 14 is positioned on the upper body portion 12, the seal ring 58 firmly contacts the shoulder 34 of the divider wall to provide an endless seal around the passage at the interface between the port 50 and aligned opening 36.

Figure 7:
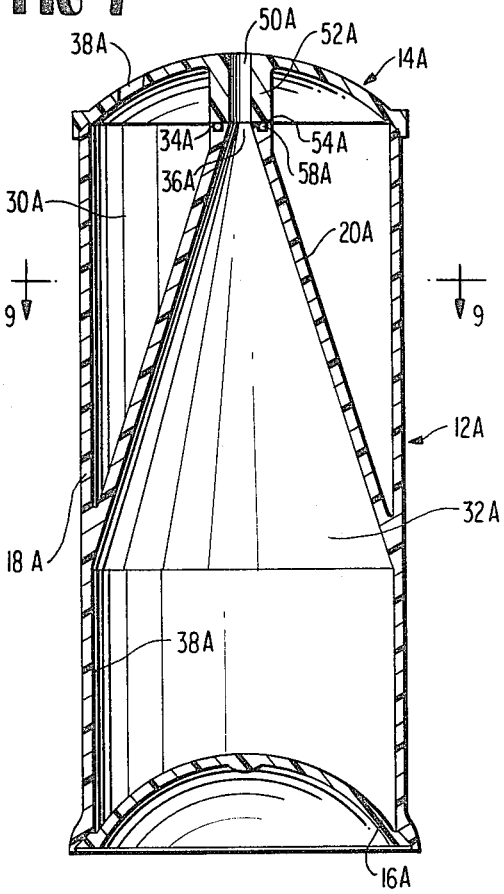
FIG. 7 is a longitudinal sectional view through an alternate embodiment of the container.

The base 16 can assume various shapes, such as a flat disc or an inverted cup (FIG. 7). In the event that the compartment 32 is to contain a pressurized substance, the inverted cup-shaped design would probably be preferred. Preferably, the base, whether flat or cup-shaped, has a peripheral edge 60 shaped complimentarily to the groove 26 formed in the bottom edge of the upper body portion 12 for being received in the latter.

The base is preferably formed of a thermoplastic material by an injection molding process.

One suitable type of thermoplastic material of which the top, base and upper body components 14, 16, 12 of the container can be molded is a copolymer, preferably Celcon oxymethylene copolymer available commercially from the Celanese Corporation.

In fabrication of the container, the top, base, and upper body portions 14, 16, 12 are each injection molded of thermoplastic material. The seal ring 50 is positioned within the groove 56 of the cap so as to project slightly outwardly therefrom. The cap portion is mounted onto the upper end of the upper body portion whereby the edge 28 of the latter enters the groove 46 and the seal ring is compressed against the shoulder 34 of the divider wall. The base portion 16 is mounted on the lower end of the upper body portion such that the edge 60 of the base enters the groove 26 in the upper body portion 12. The cap and base portions are heat-fused to the upper body portion 12 by any suitable process, such as ultrasonic welding, for example, to create leak-proof joints completely around the upper and lower ends of the container. Hence, product cannot escape from the container. Moreover, leakage between compartments is prevented by the endless seal 58 which surrounds the only possible leakage route between the compartments.

Figure 8:
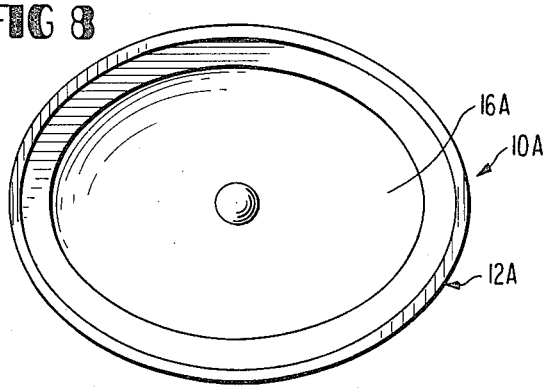
FIG. 8 is a bottom view of the container depicted in FIG. 7.

It will be appreciated that the container as well as the openings, ports, and seal ring can be of any suitable cross-sectional configuration and the seal ring can be mounted in the shoulder 34 of the divider wall rather than in the cap 14 (see FIG. 8).

The container compartments formed by the present invention are suitable for containing most types of substances, pressurized or not, which can be discharged through the discharged ports. For example, one compartment may contain shaving cream under pressure, with after-shave lotion or cologne disposed in the other compartment.

The discharge ports 48, 50 can be provided with any suitable type of closing means, such as a threaded closure 70 or an aerosol nozzle 72.

The divider wall can assume any shape which prior the insertion of the cap 14, provides a seal along the entire interface with the cylindrical wall and provides a shoulder around the opening 36 against which an endless seal ring may engage. For example, the divider wall, rather than being curved, could be flat, and extend toward an upper side of the wall 18, with an opening being defined by the flat divider wall. In one instance the divider wall could intersect the side of the wall 18 with the opening being formed by a hollow collar extending upwardly intermediate the ends of the divider wall.

Figure 9:
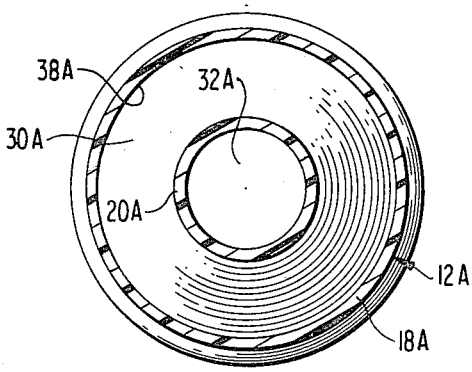
FIG. 9 is a cross-sectional view taken along line 9—9 of FIG. 7.

Another alternative embodiment of the present invention is depicted in FIGS. 7 to 9 wherein cap, upper body, and base portions 14A, 12A, 16A are of circular cross section. The divider wall 20A is frustoconically shaped and is joined to an inside surface 38A of the confining wall 18A intermediate the upper and lower ends of the upper body 12A. At its upper end the divider wall forms an opening 36A located centrally of the upper body 12A in alignment with the longitudinal axis of the cylinder 18A. The cap 14A includes a pair of ports 48A, 50A, the former communicating with a compartment 30A which surrounds the divider wall 20A. The port 50A is defined by a depending collar 52A which includes a shoulder 54A that engages (or substantially engages) a shoulder 34A surrounding the opening 36A. A circular seal ring 58A is positioned within a recess 56A in the shoulder 34A and sealingly engages the shoulder 54A of the cap.

The base 16A is of inverted cup-shaped configuration and forms the bottom of a compartment 32A which is bordered at the top by the divider wall 20A.

Alternatively, the divider wall 20A may be made non-symmetrical about the longitudinal axis of the wall 18A whereby the opening 36A is spaced laterally of such axis.

It will be appreciated that a multi-compartment container according to the present invention minimizes the chances for leakage to occur betwen the compartments. Since the divider wall, prior to insertion of the cap, intersects the upper body portion at all locations other than the opening defined by the divider wall, and since such opening is sealingly surrounded by an endless seal after insertion of the cap, it is assured that no leakage routes will exist between compartments.

The arrangement according to the present invention may be ideally formed by injection molding whereby the section between the divider wall and base is in the form of a one-piece integral joint. The container can thus be made inexpensively and with little chance of leakage.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A multi-compartment container comprising:

a body portion formed of thermoplastic material and including a confining wall forming upper and lower ends and an inner space therewithin, a divider wall integrally formed with said confining wall and dividing said inner space into a plurality of compartments, and a separately formed base connected to said confining wall for closing off said lower end of said confining wall and forming a bottom for a first of said compartments;

said upper end of said confining wall forming a first continuous edge;

said divider wall intersecting an internal surface of said confining wall and including a second edge forming an opening adjacent an upper end of said body portion communicating with said first compartment, said opening disposed internally of said first edge, a top portion formed of thermoplastic material and secured to said upper end of said confining wall to form a seal therearound, said top portion including a third continuous edge overlying said first edge of said body portion and immovably fixed thereto, a downwardly projecting collar forming a fourth edge overlying said second edge, said collar forming a first port communicating with said opening to form a passage therewith, and endless resilient seal means disposed in one of said second and fourth edges and engaging the other thereof in surrounding relationship to said passage to provide a seal between said compartments.

2. Apparatus according to claim 1, wherein said divider wall intersects said inner surface intermediate the upper and lower ends of said confining wall.

3. Apparatus according to claim 1, wherein said opening is laterally spaced from a longitudinal axis of said body portion.

4. Apparatus according to claim 1, wherein said opening is co-axial with a longitudinal axis of said body portion.

5. Apparatus according to claim 1, wherein said divider wall is of generally frustoconical configuration.

6. Apparatus according to claim 1, wherein said confining wall has an oval cross-sectional configuration.

7. Apparatus according to claim 1, wherein said confining wall has a circular cross-sectional configuration.

8. Apparatus according to claim 1, wherein said endless seal means comprises a compressible ring disposed in a groove carried by said one of said second and fourth edges.

9. Apparatus according to claim 1, wherein said top closure is of inverted cup-shaped configuration.

10. Apparatus according to claim 1, wherein said first and third edges are correspondingly beveled, said cover portion including an outer flange which extends below said bevels.

11. Apparatus according to claim 1, wherein said base is upwardly concave.

* * * * *